United States Patent [19]

Orlicki et al.

[11] Patent Number: 4,920,842

[45] Date of Patent: May 1, 1990

[54] PASSIVE WEB CUTTER

[75] Inventors: David M. Orlicki, Rochester; David B. Gropp, Fairport; Thomas E. VanValkenburgh, Rochester, all of

[73] Assignee: Eastman Kodak Company, Rochester, N.Y.

[21] Appl. No.: 387,182

[22] Filed: Jul. 31, 1989

[51] Int. Cl.[5] ..... B26D 7/14

[52] U.S. Cl. ..... 83/308; 83/63; 83/175; 83/176; 83/183; 83/310; 83/322; 83/341; 83/360; 83/674; 83/DIG. 1; 242/56 R

[58] Field of Search ..... 83/18, 63, 176, 360, 83/403, 674, 913, DIG. 1, 310, 322, 341, 175, 183, 308; 242/56 R

[56] References Cited

U.S. PATENT DOCUMENTS

| | | | |
|---|---|---|---|
| 2,242,645 | 5/1941 | Frost | 83/176 |
| 3,270,599 | 9/1966 | Kleist | 83/63 |
| 3,506,518 | 4/1970 | Klein | 242/56 R |
| 3,557,648 | 1/1971 | Coffin | 83/176 |
| 3,881,383 | 5/1975 | Alverth et al . | |
| 4,175,456 | 11/1979 | Seragnoli | 83/176 |
| 4,404,880 | 9/1983 | De Luca | 83/322 |
| 4,527,750 | 7/1985 | Juntti | 242/56 R |

*Primary Examiner*—Frank T. Yost
*Assistant Examiner*—Scott A. Smith
*Attorney, Agent, or Firm*—G. Herman Childress

[57] ABSTRACT

A web cutter for use in high speed web transport machines has a roller with a hub, two flanges and three knives supported on the hub between the flanges. In one preferred embodiment the web rides on shoulders provided on the flanges. In another embodiment, the web rides on spacers that are held in position by spring biased conically tipped pilot pins. In a third embodiment the web rides on a slotted cylinder. In all embodiments the web is brought into engagement with one of the knives directly in response to excessive tension in the web.

14 Claims, 2 Drawing Sheets

PASSIVE WEB CUTTER

BACKGROUND OF THE INVENTION

This invention relates to overtension release web cutters particularly for use with high speed web transport machines, such as used in the manufacture or processing of photographic film, paper manufacturing, and printing. In such machinery, failures may occur in the web path control due to loss of electrical power, machinery jams or defective webs. Such failures can result in tension transients propagated through the web which may damage machine tooling by, for instance, bending roller shafts and misaligning or breaking punches. Some webs, particularly webs of polyester film, exhibit extremely high tensile strength and tear or break/snap only at tension exceeding hundreds of pounds per inch width of product.

Web severing devices are known in the printing industry, particularly in association with high speed printing presses. Such devices are designed to sever a paper web to prevent torn portions of the web from continuing into the press and thus prevent damage to such press. Web severing action is initiated either by an operator manually tripping a switch, or automatically in response to a signal received from a web break detector located along the web path.

One such web severing device is described in U.S. Pat. No. 3,881,383. The device includes a pair of rollers mounted on a press on opposite sides of the web. The upper roller has a fixed axis of rotation. The lower roller is movable, by a pneumatic device, in an up and down fashion toward and away from the upper roller. In the preferred embodiment the lower roller carries a severing blade which always protrudes beyond the outer cylindrical surface of such roller. Upon being triggered, preferably by a web break detector, the lower roller is forced upward by the pneumatic device into engagement with the web. Thereupon the motion or momentum of the web is utilized to rotate the lower roller and swing the cutting blade into engagement with the web to sever the web. Column 5, lines 18–21 of the patent indicates the blade could be mounted on the stationary roller instead of the movable roller.

Solenoid actuated guillotine cutters are also known in the film industry. However, in equipment such as spoolers and slitters where the film is traveling at high speeds (for instance 2000 ft./min.), the time it takes to detect an overtension condition in the film, then actuate the solenoid, and then for the cutter to sever the web may not be fast enough to prevent damage to the machine. In fact detectors and solenoid actuators may be inoperable if the tension transient results from an electrical failure in the machine.

SUMMARY OF THE INVENTION

An object of the present invention is to provide a purely passive device to sever a web in the event of a tension transient of a magnitude greater than or equal to a predetermined threshold level. Another object is to provide a web cutter wherein no external or additional device is required to detect the undesired tension transient, and no power source, other than the energy in the moving web itself, is required to actuate the cut.

A passive cutter of the invention can be used for severing a web or film in the event the tension in such web or film reaches a predetermined and undesirable threshold. The cutter includes a rotatable hub, mounted for rotation about a fixed axis. A knife for cutting the web is supported by the hub for rotation with the hub. The cutter also includes means for supporting the web for travel along an arcuate path spaced from the knife when tension in the web is below the predetermined level. The supporting means enables the web to move radially inwardly into contact with the knife to sever the web when tension in the web reaches the predetermined threshold.

In one preferred embodiment, the web is supported on shoulders on flanges fixed to opposite ends of the hub. In another embodiment, the shoulders are provided on spacers positioned beside the knife. In a third embodiment, the web is supported on a slotted cylinder yieldably positioned between flanges fixed to the opposite ends of the hub.

DESCRIPTION OF THE PREFERRED EMBODIMENTS

Figure 1:
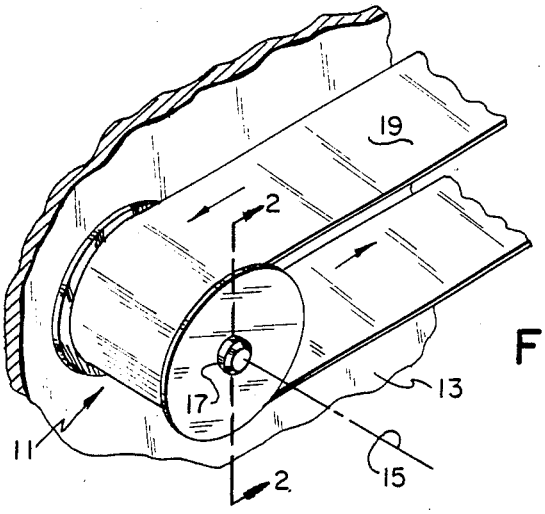
FIG. 1 is a schematic view of one preferred embodiment of a web cutter of the present invention shown mounted to a frame member of a web transport machine.
Figure 2:
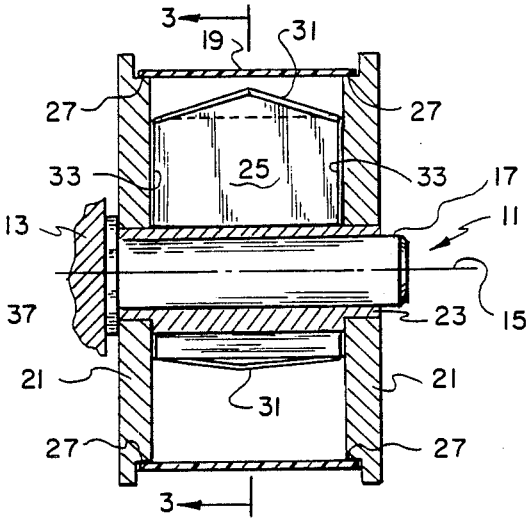
FIG. 2 is a cross-sectional view of the web cutter of FIG. 1, taken along line 2—2 of FIG. 1.
Figure 3:
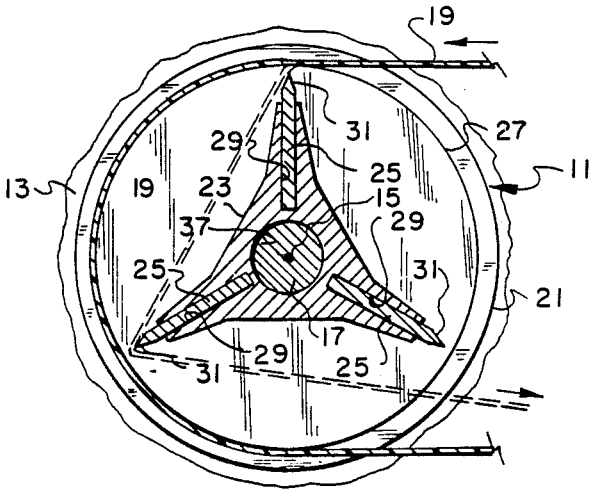
FIG. 3 is a cross-sectional view of the web cutter taken along line 3—3 of FIG. 2.

One embodiment of a web cutter of the invention is generally designated 11 in FIGS. 1–3. Cutter 11 is shown mounted to a machine frame member 13 for rotation about a fixed axis 15 of a shaft 17. Web cutter 11 is driven only by the movement of a web or film 19 trained about the cutter. While the preferred embodiments are particularly useful for 35 mm photographic film, web cutter 11 is also useful in cutting other films or webs such as paper or metal foils, and adhesive tapes (with paper or plastic substrates).

With reference to FIGS. 2 and 3, web cutter 11 includes a pair of spaced flanges 21 that project radially outwardly from the ends of a hub 23. Three knives 25 also project radially from the hub. The knives are between the flanges and equally spaced about the circumference of the hub. Flanges 21 each include an annular shoulder 27 at the outer edge of the flange for supporting the side edges of film 19. As illustrated in FIGS. 1 and 3, the film travels along an arcuate path of about 180° around the flanges. There is sufficient friction between the film edges and the flanges to rotate the flanges, hub and knives about axis 15. The beam strength of the web is sufficient to prevent it from collapsing between the shoulders 27 when the tension in the web is below a threshold value. The threshold tension value is above the tension normally encountered by the web.

Referring to FIG. 3, hub 23 includes three generally V-shaped portions having slots 29 for supporting knives 25. A large portion of the knives 25 are enclosed by V-shaped portions of the hub, thus providing a rigid support for the knives 25. Knives 25 each include a V-shaped cutting portion 31 that projects from slot 29. The center of the V is equidistant from the outside edges 33 of the blade and projects further from the hub than the outside edges to form a point. The cutting portion 31 of each blade is radially inward of shoulders 27. Hub 23 also has a cylindrical opening 37 for receiving shaft 17.

In operation, web cutter 11 is rotated about axis 15 by web 19 in response to movement of the web. In normal operation the tension in the web is below the threshold value, i.e., below the value which causes the web to collapse from shoulders 27 and enter the space between flanges 21. Thus normally the cutter acts simply as a roller and the web is supported by the shoulders for travel along an arcuate path about axis 15 and spaced from the knives as shown in FIGS. 1-3. However, at times the tension in web 19 will exceed the threshold value as, for example, in response to a power failure or other event affecting the normal travel of the web about the cutter. When this occurs, web 19 will immediately collapse into the channel formed by flanges 21 and 23 and onto one of the knives 25 as shown in phantom in FIG. 3. Because of the V-shape of cutting portion 31, web 19 will be cut beginning near its center line, with the cut spreading outward toward both web edges, as web 19 is forced over knife 25. The V-shape of the cutting portion aids in shearing web 19 with minimum blade pressure and, therefore, minimizes the tension induced into web 19 by the cutting operation. By having three equally spaced knives, one ofthe knives will always be in a position to cut the web.

The threshold tension in the web required to cause cutting of the web is determined by several factors. For example, the threshold tension varies with the beam strength of the web, the width of the web, the width of shoulders 27, and the width of the portions of the web resting on the shoulders. The maximum threshold tension should be less than a tension that will damage other portions of the machine incorporating the cutter, and the minimum threshold tension should be more than the tension encountered by the web in normal operation of the machine.

Web cutter 11 is very simple and works well with acetate base film, for example. In applications with very high strength webs, such as with polyester base films, it has been determined that shoulders 27 should be very narrow in order to permit web 19 to collapse onto the knives in response to a tension transient that is low enough to avoid damaging other portions of the machine. More specifically the shoulders need to be sufficiently narrow to concentrate the stress of the tension transient to a local peak at the shoulder that is above the yield strength of the web. However, because of the narrow width of shoulders 27, the width of web 19 must be closely toleranced in order to fit between flanges 21 and not fall between shoulders 27 and be severed when there is no undesirably high tension transient. The embodiment of the invention illustrated in FIGS. 4 and 5 avoids this problem.

Figure 5:
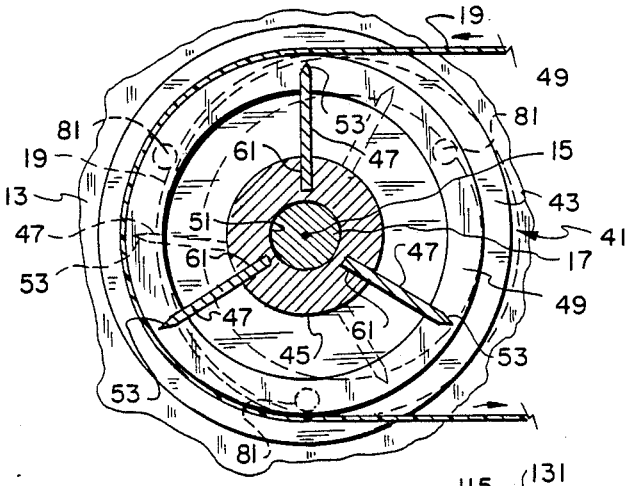
FIG. 5 is a cross-sectional view taken along lines 5—5 of FIG. 4*a;*

Referring now to FIGS. 4 and 5, another embodiment of the web cutter is generally designated 41. Cutter 41 is similar to cutter 11 and includes a pair of spaced flanges 43, a hub 45, and three knives 47 between the flanges. Flanges 43 are rigidly secured to hub 45 in any conventional manner, or are integrally formed with the hub. Hub 45 also has a cylindrical opening 51 for receiving shaft 17.

Figure 4A:
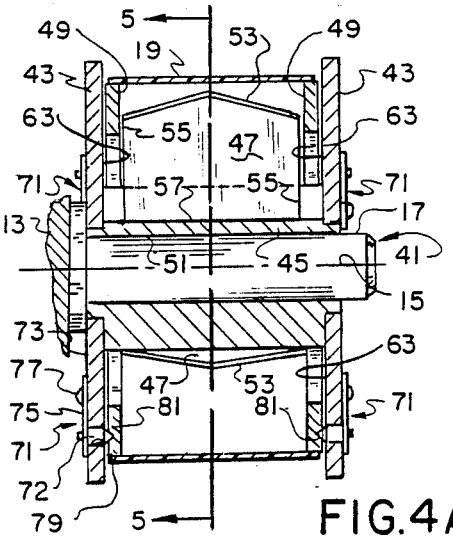
FIG. 4*a* is a cross-sectional view of another embodiment of the web cutter that is especially desirable for high tensile strength film applications.

Knives 47 each include a V-shaped cutting portion 53, outside edges 55 and a bottom edge 57. As with the first embodiment, the center of the V is equidistant from outside edges 55 and projects further form the hub than the outside edges. The cutting portion of each blade is radially inwardly of the outer edge of flanges 43. Bottom edges 57 of the blades are seated in slots 61 formed in hub 45, as particularly illustrated in FIG. 5. The side edges 55 of the knives are spaced slightly from flanges 43, as shown in FIG. 4*a*.

A pair of annular spacers 49 are positioned between side edges 55 of knives 47 and inner surfaces 63 on flanges 43. The inside diameter of each spacer is larger than the outside diameter of the adjacent portion of the hub, and the spacers are movable radially relative to the knives and flanges. The outside diameter of each spacer 49 is less than the outside diameter of the adjacent flange 43, thereby forming spaced shoulders for holding the side edges of web 19. Normally the axis of each spacer is aligned with axis 15, and in this position the arcuate path of the web is just above the knives 47.

Figure 4B:
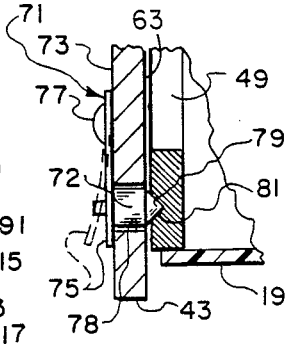
FIG. 4*b* is an enlarged fragmentary detail of one of the pin retainer assemblies of FIG. 4*a;*

In order to prevent radial motion of the spacers relative to the axis of rotation 15 of cutter 41 during normal operations, six conically tipped pilot pin assemblies 71 are provided, three for each spacer 49. As best shown in FIG. 4*b*, each assembly 71 includes a pin 72 attached to a leaf spring 75. Spring 75 is secured to the outer side 73 of a flange 43 by fasteners 77. The pin 72 extends through an opening 78 in flange 43, and a conical tip 79 on the pin is received in a corresponding conical pilot hole 81 in spacer 49. Three assemblies 71 are provided on each flange 43, and the assemblies are spaced 120° apart.

Web 19 is trained around the outer edges of spacers 49. In normal operation, the conical tips 79 of the pins 72 on each flange 43 are held in the mating pilot holes 81 by springs 75 so that spacers 49 are held against edges 55 of knives 47. At this time the axes of the spacers are aligned with axis 15 of shaft 17, and the web is supported by the spacers radially outward of the knives. In an over tension situation, the force transmitted from web 19 to spacers 49 acts through the cone angle of pilot holes 81 on pins 72, thus forcing the pins outwardly against the force of springs 75. This releases the spacers 49 so they can slide radially relative to hub 45. The portions of the spacers engaged by the web moves toward the hub, as shown in phantom in FIG. 5. This motion brings web 19 into contact with one of the knives 47 and it is severed in the manner described previously for web cutter 11. The collapse force threshold of spacers 49, and thus the tension force required for cutting of the web, can be set by selection of the cone angle of tip 79 and pilot hole 81, in conjunction with the spring rate of springs 75.

Figure 6:
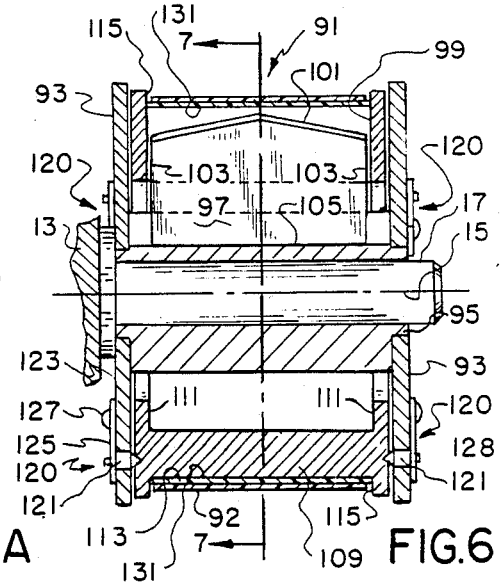
FIG. 6 is a cross-sectional view of a third embodiment of the web cutter.
Figure 7:
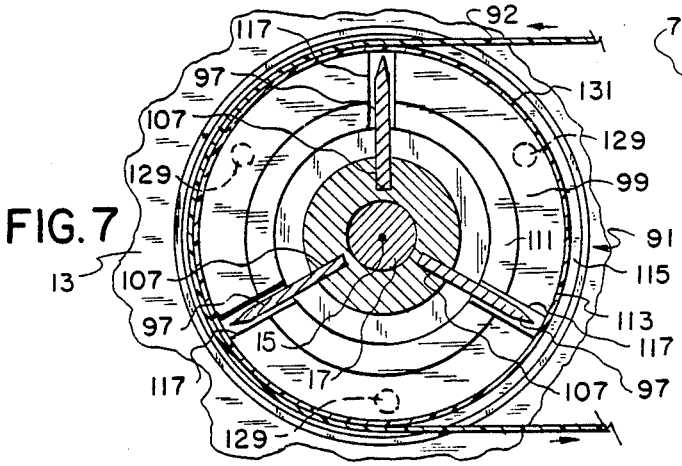
FIG. 7 is a cross-sectional view taken along lines 7—7 of FIG. 6.

Web cutter 41 is suitable for a web with a relatively high beam strength, i.e., a beam strength sufficient not only to support web 19 on annual spacers 49 but also sufficient to release the pin assemblies and drive the spacers to the position shown in phantom in FIG. 5 without the web collapsing between the spacers. In FIGS. 6 and 7 an alternate web cutter 91 is shown which is suitable for a web 92 having sufficiently low tensile strength, or which is so pressure sensitive, that it cannot be supported solely by shoulders 27 (FIGS. 1, 2) or spacers 49 (FIGS. 3, 4).

Web cutter 91 comprises spaced flanges 93 that extend radially from the ends of a hub 95. The hub has a cylindrical opening for receiving shaft 17. Three knives 97 are carried by the hub and project therefrom at 120° intervals. A slotted cylinder 99 is located between flanges 93.

As with the embodiment illustrated in FIGS. 3 and 4, each knife 97 includes a V-shaped cutting portion 101, outside edges 103 and a bottom edge 105. The center of the V is equidistant from outside edges 103. Bottom edges 105 are seated in slots 107 formed in hub 95. Knives 97 are constructed from thin metal, for example, approximately 0.01 inches thick, so as to be flexible under forces normal to the blade surface, but rigid to radial forces encountered during web cutting. Inconel or stainless steel are suitable materials for the knives.

Support cylinder 99 includes a cylindrical portion 109 and radially inwardly projecting flanges 111. The cylinder 99 has a generally cylindrical outer surfce 113 and a pair of spaced shoulders 115 project radially outwardly from the ends of surface 113. The radially inner edges of flanges 111 normally are spaced from hub 95, and surface 113 normally is spaced radially above the knives 97. Three slots 117 extend the length of cylindrical portion 109 and are angularly spaced apart 120° as best illustrated in FIG. 7. Knives 97 project into slots 117. As the slots are wider than the blades, the cylinder can move radially relative to the blades.

Cylinder 99 is held in its normal operating position concentric with axis 15, as shown in the drawings, by six conically tipped pilot pin assemblies 120; three such assemblies being spaced 120° apart on each of flanges 93. The assemblies 120 are similar to assemblies 71 described previously. More specifically, each assembly 120 includes a pin 121 that passes through an opening 122 in a flange 93. The pin is secured to a leaf spring 125 that is attached to the outer side 123 of a flange 93 by a fastener 127. The conical tip 128 of the pin 121 is received in a mating pilot hole 129 provided in a flange 111.

The knives 97 and slots 117 are dimensioned relative to each other such that the V-shaped point at the center of each portion 101 normally is just below the surface 113 of cylinder 99. The radial spacing between the inner diameter of flange 111 and the outer diameter of hub 95 exceeds the spacing between the outer surface 113 of cylinder 99 and the point of the V-shaped cutting portion 101 of knives 97. This enables one of the cutting portions to project above the surface 113 when cylinder 99 is moved radially toward hub 95 in response to tension in the web above a threshold value, as described in more detail later.

For certain webs, the surface 113, which is interrupted by slots 117, may cause surface embossing of web 92 with lateral striations. This can be avoided by placing over cylindrical surface 113 a cover 131 which will support the web on the surface and over the slot. Cover 131 can be an expendable sleeve of thin plastic or elastic material, which is easily cut by any one of knives 97 as it emerges from its corresponding slot 117 in the event of an overtension condition.

In an overtension situation, the force transmitted from the web 92 to suppot cylinder 99, and acting through the cone angle of pilot holes 129 deflects pins 121 against the force of leaf springs 125 and causes the portion of cylinder 99 shown at the left in FIG. 7 to slide radially inwardly towards hub 95. As this occurs, the cutting portion of the knife shown at the left in FIG. 7 will project out of its slot 117 and the web is severed in the same manner as described in connection with web cutters 11 and 41. The other blades flex to enable this movement of the cylinder 99. As with web cutter 41, the collapse force threshold can be set by selection of the cone angle of pin tips 128 and pilot holes 129, in conjunction with the spring rate of springs 125. To a lesser extent the force required to penetrate cover 131 is a factor in determining the collapse force threshold.

If the knives 97 were fixed and rigid relative to forces normal to their faces, they would bind in slots 117, as cylinder 99 moved radially toward hub 95, and prevent knives 97 from severing web 92. However, since knives 97 are flexible under forces normal to the blade surface, knives 97 flex so as to maintain engagement in their respective slots 117 while cylinder 99 moves radially relative to hub 95. Because of the depth of penetration of knives 97 in slots 117 and the normal radial spacing between the inner diameter of flanges 111 and the outer diameter of hub 95, even the knife 97 opposite the point of contact between cylinder 99 and hub 95 will remain in its slot 117.

There are several advantages of web cutters 11, 41 and 91, relative to other methods of cutting the web during an overtension condition in the web. First web cutters 11, 41 and 91 are purely passive. No external device is required to detect the tension transient and no external power source, other than the energy in web 19 or 92, is required to affect the cut. Thus, cutters 11, 41 and 91 will operate in the event of machine power failure, one of the principle sources of catastrophic tension transients. Additionally, cutting surfaces of knives 25, 47 and 97 rotate about a fixed axis 15, and the center of curvature of the portion of the web around the cutter also is located along axis 15, so the web is always close to one of the knives. Also, the knives are always moving at a tangential velocity closely matched to the surface speed of the web. This speed match at the instant of knife penetration minimizes the roller acceleration required in prior systems to maintain web to knife contact in the line of cutting throughout the cutting time interval. Devices utilizing blades fixed to a machine frame can induce extremely large tension transients between the time the blade first penetrates the web, until the web is completely severed. Finally, the design of web cutters 11, 41 and 91 ensures that the knives are the first rigid object encountered by a web as it collapses from its normal path during an overtension failure.

While the drawings and accompanying description show and describe preferred embodiments of the present invention, it will be apparent to those skilled in the art that various changes may be made in the form of the invention within the scope of the claims. For example, in the illustrated embodiments knives 25, 47 and 97 are V-shaped, however other blade configurations would work, so long as the web falls on a relatively sharp point. Similarly, plastic shear pins could be used in place of, for instance, assemblies 71 or 120.

What we claim is:

1. A passive cutter for severing a web under tension in response to the tension in the web reaching a predetermined threshold, the cutter comprising:

(a) a rotatable hub;

(b) means mounting the hub for rotation about a fixed axis;

(c) at least one knife for cutting the web, said knife being supported by the hub for rotation with the hub, the knife projecting from said hub in a radial direction relative to the axis; and (d) means for supporting the web for travel along an arcuate path about the axis and spaced from said knife when tension in the web is below said predetermined threshold, the suporting means enabling the web to move radially inwardly into contact with the knife to effect severing of the web when tension in the web reaches the predetermined threshold.

2. The cutter of claim 1, wherein said supporting means includes a pair of spaced shoulders engageably by the web, said shoulders being separated so that the shoulders are only contacted by the side edges of said web.

3. The cutter of claim 2, wherein said supporting means includes (1) a pair of flanges fixed to said hub and (2) a pair of spacers defining said shoulders, said knife has side portions positioned in spaced relationship with said flanges and said spacers are movable between said flanges and said side portions of said knife in response to tension in the web .

4. The cutter of claim 3, further including means responsive to tension in the web for releasably holding said spacers relative to said flanges in a position wherein said web is supported in spaced relation to said cutting portion of said knife.

5. The cutter of claim 4, wherein said holding means comprises means carried by the flanges and resiliently urged against the spacers.

6. The cutter of claim 4, wherein each of said spacers has at least two conically shaped pilot holes, at least two conically tipped pilot pins carried by said flanges, and springs for urging the pins into said pilot holes, whereby said spacers are held against said side portions of said knife when tension in the web is less than the predetermined threshold, and whereby when the tension in said web reaches said predetermined threshold the force transmitted from said web to said spacers and acting through the cone angle of said pilot holes onto said pins deflects said pins out of the holes against the force of said springs, thereby enabling the web to force a portion of said spacers radially toward said hub so that the web is severed by said knife.

7. The cutter of claim 1, wherein said knife has a generally V-shaped cutting portion with a center that projects further from the hub than the outside edges to facilitate cutting of the web.

8. The cutter of claim 1 wherein said hub includes three knives, equally spaced around said hub so that one of said knives is always in a position to be engaged by the web if tension in the web reaches the predetermined threshold level.

9. The cutter of claim 2, wherein said supporting means is fixed to said hub, said knife is positioned between said shoulders and spaced radially inward from said shoulders so it is out of contact with the web when tension in the web is below the predetermined threshold level.

10. The cutter of claim 1, wherein the means for supporting said web includes a pair of flanges supported by said hub and a member having a generally cylindrical surface for supporting the web, means for releasably holding said member between said flanges with the surface coaxial with the hub when tension in the web is below the predetermined threshold level, said member having a slot for receiving a portion of said knife.

11. The cutter of claim 10, wherein said member has on opposite ends thereof at least two conically shaped pilot holes, at least two conically tipped pilot pins carried by said flanges, and springs biasing the pins into said pilot holes so that when the tension in the web reaches the predetermined threshold, the force transmitted from said web to said cylindrical surface and acting through the cone angle of said pilot holes onto said pins deflects said pins out of the holes against the force of said springs, thereby enabling a portion of said cylindrical member to move radially inwardly toward said hub so that said web is cut by said knife.

12. The cutter of claim 11, wherein said hub includes three knives equally spaced around said hub, and said member has three slots for receiving said knives.

13. The cutter of claim 12, wherein said knives are flexible under forces normal to the blade surface, but rigid to radial forces encountered during web cutting.

14. Th cutter of claim 10 further comprising a cover over the cylindrical surface and the slot for supporting the web, the cover being of a material which is easily cut by the knife.

* * * * *